US007621215B2

(12) United States Patent
Dewitt

(10) Patent No.: US 7,621,215 B2
(45) Date of Patent: Nov. 24, 2009

(54) METHODS AND APPARATUS FOR FORMING VARIABLE SPACED RELIEF PATTERNS WITH A SINGLE TOOL PAIR AND ARTICLES PRODUCED THEREBY

(75) Inventor: Steve Dewitt, Tacoma, WA (US)

(73) Assignee: Northwest Door, Inc., Tacoma, WA (US)

( * ) Notice: Subject to any disclaimer, the term of this patent is extended or adjusted under 35 U.S.C. 154(b) by 308 days.

(21) Appl. No.: 11/535,013

(22) Filed: Sep. 25, 2006

(65) Prior Publication Data

US 2007/0084360 A1 Apr. 19, 2007

(51) Int. Cl.
*B31F 1/07* (2006.01)

(52) U.S. Cl. ..... 101/32; 101/16; 101/29

(58) Field of Classification Search ..... 101/3.1, 101/24, 28, 31.1, 32, 12, 16, 17, 29, 30, 31
See application file for complete search history.

(56) References Cited

U.S. PATENT DOCUMENTS 4,059,479 A * 11/1977 Tanazawa ..... 430/320
6,676,587 B2 * 1/2004 Smith et al. ..... 493/143
6,766,733 B1 * 7/2004 Collins ..... 101/28
2002/0139255 A1 * 10/2002 He et al. ..... 101/32
2003/0131739 A1 * 7/2003 Sarnstrom ..... 101/16
2003/0209334 A1 * 11/2003 Jella ..... 160/236
2004/0138035 A1 * 7/2004 Boulton ..... 493/51
2005/0257594 A1 * 11/2005 Hutchison et al. ..... 72/482.93
2006/0175018 A1 * 8/2006 Biller ..... 156/553

* cited by examiner

*Primary Examiner*—Daniel J Colilla
*Assistant Examiner*—David Banh
(74) *Attorney, Agent, or Firm*—Graybeal Jackson LLP

(57) ABSTRACT

A method for making an embossed article, tools used to make such articles and the resulting article are disclosed. The article includes a first composite element having a plurality of spaced apart subelements, which is created by mounting a first embossing tool to an embossing press wherein the first embossing tool includes first and second male dies, as well as mounting a second embossing tool in registered opposition to the first embossing tool, which includes first and second female dies complementary in number, type and position to the respective first and second male dies. After positioning a first deformable sheet material between the first and second embossing tools, the first male dies and the first female dies are compressed, the sheet is moved, and the second male dies and second female dies are compressed. Alternatively, at least some of the dies are moved or replaced prior to the second compressing actions, which may be to the same or different sheet material.

14 Claims, 2 Drawing Sheets

FIG. 2
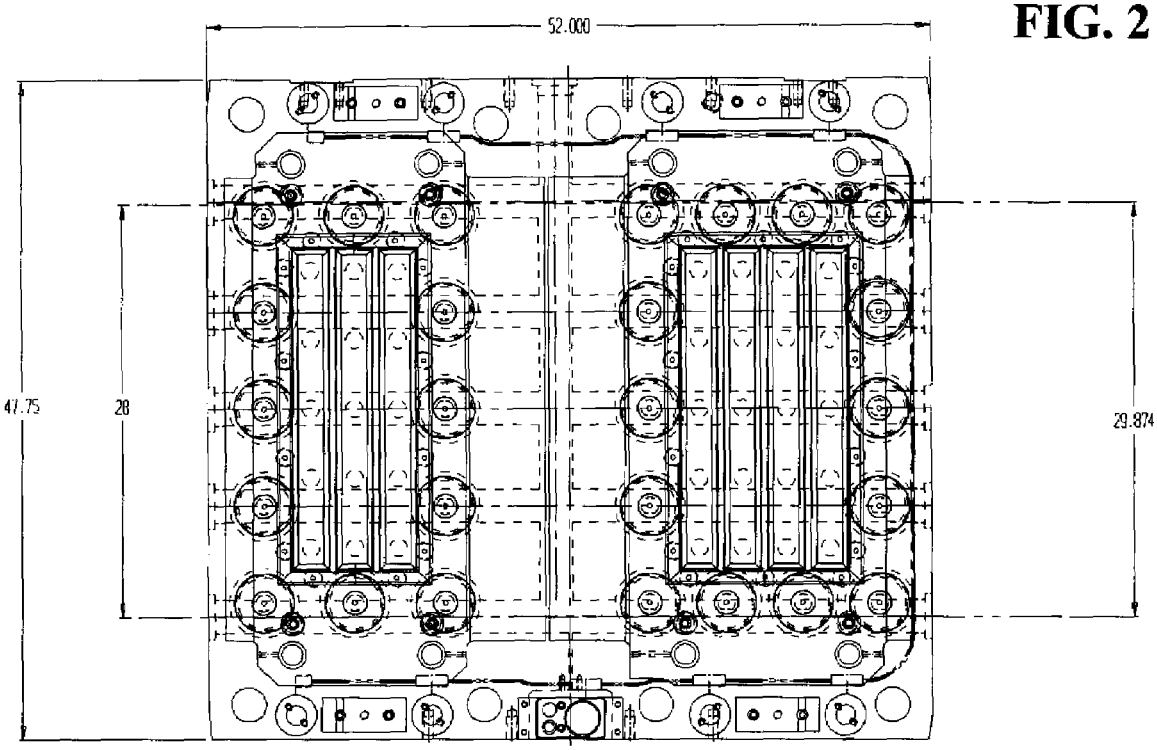
28" PANEI
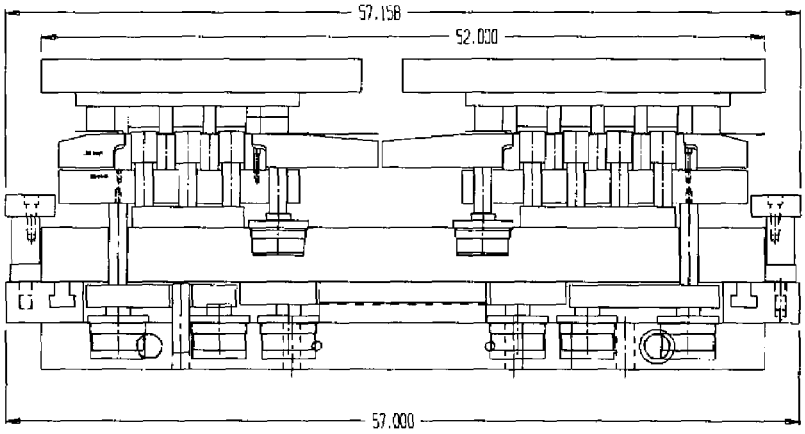
FIG. 3

METHODS AND APPARATUS FOR FORMING VARIABLE SPACED RELIEF PATTERNS WITH A SINGLE TOOL PAIR AND ARTICLES PRODUCED THEREBY

BACKGROUND OF THE INVENTION

In the field of garage doors, it is common to link a plurality of sections together to form a sectional door. To increase the aesthetic appearance of such doors when constructed from a planar material such as sheet metal, it is common to emboss some or all sections with a field pattern, e.g., wood grain, and frequently enhance the sections with selectively placed design elements, e.g., raised or recessed panels, to emulate traditional wood door designs.

A common technique for creating both the field pattern as well as the selectively placed design elements in sheet metal sections involves creating a stamping or rolling tool pair having the inverse of the pattern(s) to be embossed on the section, and subjecting a deformable sheet material to the embossing process using the tool pair. If a different pattern is desired, another tool pair must be created and applied. As a consequence, the variety of resulting sections is generally limited by the economics associated with fabricating a new stamping or rolling tool pair. In addition, if the section dimensions vary, either another tool pair must be used, or an existing tool pair is used with the resulting embossed pattern(s) being disproportionate for the formed section. While the foregoing deficiencies are generally not applicable to field patterns (the embossing tool can be formed to meet the requirements of the largest anticipated section and over-utilized for smaller sections), it is acute with respect to design elements such as panels. Thus, a panel element or combination of panel elements that may be appropriately sized and spaced for a section of one size would likely not be appropriately sized for a section of a materially different size; a new tool pair would have to be created to maintain a similar overall visual appearance. Thus, the manufacturer is left with the choice of either investing in fabrication of a new tool pair, or use the old tool pair and accept an inferiorly designed section.

SUMMARY OF THE INVENTION

The invention relates to methods for manufacturing generic embossed sheets or skins comprising relief patterns, and particularly garage door sections, from generally planar materials using a single tool pair. As a result of compressive contact by the tool pair against a generally planar material, at least one embossed composite design element comprising a plurality of purposefully spaced design subelements is created, wherein the subelements may have variable spacing there between, the degree of spacing being user definable. If a plurality of embossed composite design elements are formed, they may also have variable spacing there between, the degree of spacing also being user definable. Moreover, the same functionality that governs spacing parameters of design subelements or embossed composite design elements also permits the use of different design subelements by the same tool pair, thereby further reducing the number of tools necessary for creating a desired pattern in a sheet or skin. The invention further relates to generally planar structures such as garage door sections resulting from the practice of such a method and to apparatus for carrying out the method and/or making the embossed sheets or skins.

Looking first to the nature of the generally planar starting material, it comprises a deformable material, which is subsequently modified through practice of the methods comprising the invention. In a preferred series of embodiments, the deformable material is a sheet material, such as sheet metal formed from steel or aluminum, although certain thermoforming compositions or thermosetting compositions (if modified prior to full curing) could be used. If the generally planar material will be used as a garage door section, modification of the deformable material either prior to or after formation of at least one embossed composite design element relief will usually be necessary to accept desired hardware and otherwise provide necessary structural qualities, as is well known by those persons skilled in the art.

The tool pair of the invention comprises a pair (male and female) of relief forming tools such as rotatable cylinders or planar stamps constructed from a material having greater hardness than the deformable material comprising the generally planar material. Each tool defines at least one cavity for accepting at least one die having a greater hardness that the deformable material, the at least one die corresponding to at least one design subelement. Preferably, each tool has a cavity of sufficient size to accept a plurality of dies (as used herein, a single die may correspond to one of a plurality of design subelements; if a die comprises a plurality of design subelements, then variable spacing of the subelements present in the die and resulting article, from application of such a die, is not possible). However, a tool may have one cavity for each die, where each die may comprise one or a plurality of design subelement embossment patterns. If the cavity is oversized relative to the number of installed dies, then it is possible to modify the spacing between installed dies, thereby achieving variable inter-die spacing and resulting inter-subelement spacing, which is a feature of the invention. It should be noted that as used herein, "a cavity" refers to the singular as well as the plural such that "a cavity" may receive a plurality of dies or a single die, and a tool having a plurality of dies may have "a cavity" that includes two die bays. The intention is therefore not to limit the scope of the invention to issues pertaining to "cavities" but to provide suitable mounting structure for the operation of the tools using the methods disclosed herein.

Those persons having ordinary skill in the art will appreciate that an embossed composite design element may be formed from multiple passes through a tool pair having a single die (corresponding to one or a plurality of design subelements) or an array of dies (each die corresponding to one or a plurality of design subelements), where the relative position between the planar material and the tool pair is varied during each compressive pass to create additional embossed design subelements or composite design elements in the planar material. In such methods, the spacing between adjacent design subelements or between composite design elements is varied according to the relative position between the material and the tool pair. Alternatively, the tool pair can possess a cavity capable of receiving multiple homogeneous or heterogeneous die arrays that form a plurality of embossed composite design elements, thereby reducing the number of compressive passes necessary to create a desired embossed sheet or skin. In such methods, the spacing between, for example, adjacent composite design elements, is varied according to the distance between adjacent die arrays or relative position between the material and the tool pair.

A feature of the invention permits a user of the tool pair to establish the relative distance between dies corresponding to the design subelements as well as to determine the type of die (and therefore the design subelement) to use. Thus, and with respect to garage door sections, a wide variety of design combinations for a section can be achieved with a single tool given the plethora of die and spacing combinations available to the user of the tool.

As those persons skilled in the art will also appreciate, several tool pairs may be used for a single planar material, and the reliefs may be formed on one or both sides of the planar material, thereby creating protrusions and/or depressions on a single side. Thus, in some instances a plurality of tools may be necessary to achieve the final desired relief pattern (e.g., raised and depressed subelements relative to the plane of the material). Regardless of the number of tool pairs necessary to form the final article, the invention reduces the number of tools needed by eliminating the need for tool changes based upon changes in design element spacing and/or constitution by using a single tool pair having the ability to accept a plurality of dies and accommodate a variety of spacing there between.

In a presently preferred embodiment, a stamp press is used that accepts a tool pair, each having at least one cavity for accepting a plurality of dies. Those persons skilled in the art will appreciate that the number or nature of the tool cavity is considered a matter of design choice, and selection of a specific constitution is not considered to be part of the invention unless such selection affects the ability to operate the tool pairs as contemplated by the invention. Taking the foregoing into account, a first complementary pair (male and female) of three (3) subelement relief dies are located in a first pair of opposed cavities while a second complementary pair (male and female) of four (4) subelement relief dies are located in a second pair of opposed cavities. In this embodiment, intersubelement spacing is fixed by the use of triple and quad ganged subelement dies; thus, the distance between a grouping of subelements in a resulting embossed composite design element relief is constant for each compressive stamping operation. By subjecting the sheet material to one, the other or both die pairs, and by selecting the number of compressive pass exposures to each tool pair, each embossed composite design element is subject to the following formula: ($n\times3+n\times4$) where "n" is the number of compressions for each die pair, "3" refers to the triple gang die pair and "4" refers to the quad gang die pair. Thus, a sheet of material can have 3 subelements ($1\times3+0\times4$), 4 subelements ($0\times3+1\times4$), 6 subelements ($2\times3+0\times4$), 7 subelements ($1\times3+1\times4$), 8 subelements ($0\times3+2\times4$), 9 subelements ($3\times3+0\times4$), 10 subelements ($2\times3+1\times4$), 11 subelements ($1\times3+2\times4$), 12 subelements ($0\times3+3\times4$), 13 subelements ($3\times3+1\times4$), 14 subelements ($2\times3+2\times4$), etc. through the use of a single tool pair and selective movement of the sheet relative to the tool pair.

BRIEF DESCRIPTION OF THE DRAWINGS

FIG. 2 is a plan view of one of a two cavity tool pair shown with triple and quad gang dies located in respective cavities used to produce the reliefs in the door sections shown in FIG. 1; and FIG. 3 is an elevation view of the tool shown in FIG. 2.

DESCRIPTION OF THE PREFERRED EMBODIMENTS

Figure 1:
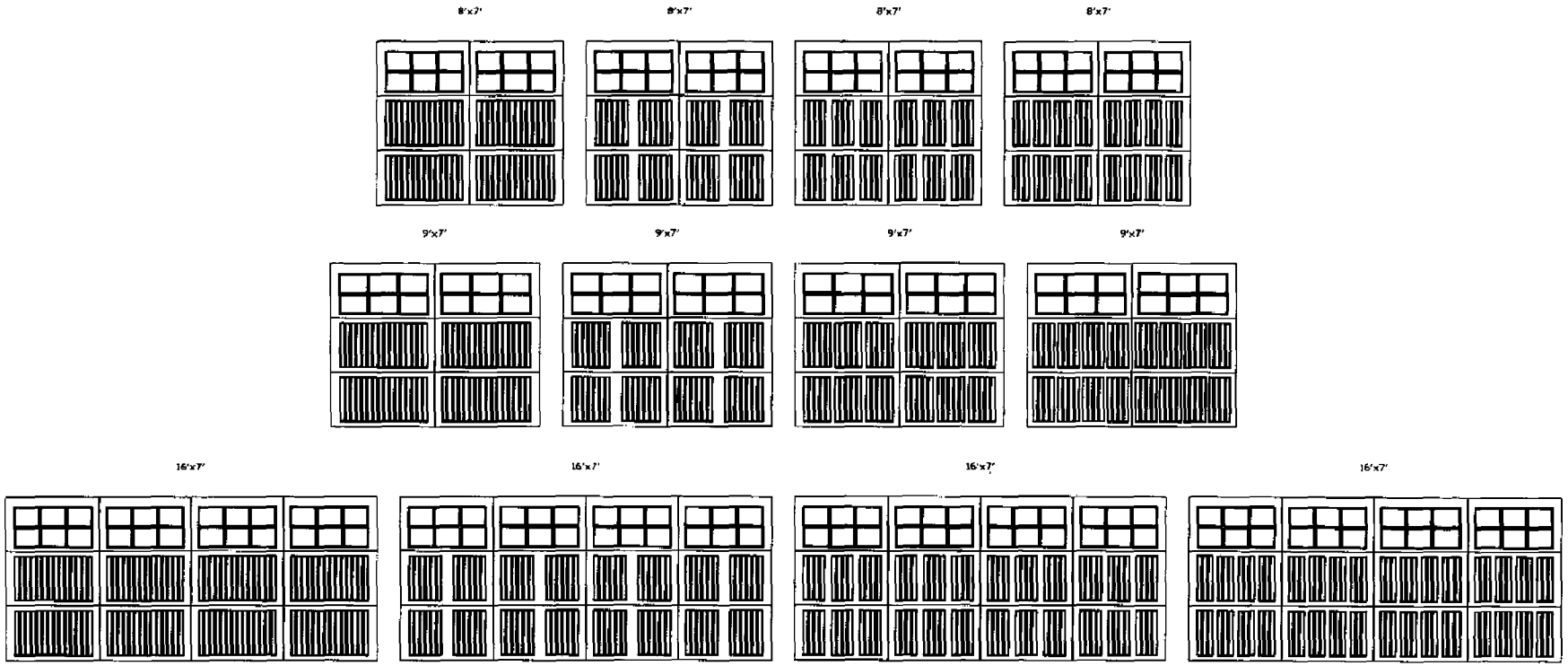
FIG. 1 illustrates 12 garage doors in three width groupings produced from a single tool pair.

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

Referring to FIG. 1, all embossed composite design element reliefs shown can be created through the use of the tool shown in FIGS. 2 and 3. As demonstrated, an 8 foot wide door section (each illustrated door has three horizontal sections, two of which are embossed to have composite design element reliefs and one of which comprises windows) can be formed to have 2, 4, 6, or 8 composite design element reliefs wherein the 2 composite design element reliefs have a total of 28 subelements (14 subelements in each composite design element relief), the 4 composite design element reliefs have a total of 24 subelements (6 subelements in each composite design element relief), the 6 composite design element reliefs have a total of 24 subelements (4 subelements in each composite design element relief, and the 8 composite design element reliefs have a total of 24 subelements (3 subelements in each composite design element relief). As noted above, the spacing between composite design element reliefs (groupings) can be established by movement of the sheet relative to the press prior to performing additional compressive embossment actions.

Similarly, 9 foot wide door sections can be formed to have similar groupings to that of the 8 foot wide door sections: 2, 4, 6, or 8 composite design element reliefs wherein the 2 composite design element reliefs have a total of 32 subelements (16 subelements in each composite design element relied, the 4 composite design element reliefs have a total of 28 subelements (7 subelements in each composite design element relief), the 6 composite design element reliefs have a total of 30 subelements (5 subelements in each composite design element relief), and the 8 composite design element reliefs have a total of 32 subelements (4 subelements in each composite design element relief).

And finally, 16 foot wide door sections can be formed to have 4, 8, 12 or 16 composite design element reliefs wherein the 4 composite design element reliefs have a total of 56 subelements (14 subelements in each composite design element relief, the 8 composite design element reliefs have a total of 48 subelements (6 subelements in each composite design element relief), the 12 composite design element reliefs have a total of 48 subelements (4 subelements in each composite design element relief, and the 16 composite design element reliefs have a total of 48 subelements (3 subelements in each composite design element relief).

Those persons skilled in the art will appreciate that additional combinations are available both with constant intersubelement spacing and particularly with respect to variable intersubelement spacing. Therefore, the combinations illustrated in FIG. 1 are for illustrative purposes only, and particularly illustrate the utility of the preferred embodiment, which uses triple and quad gang die pairs in a single tool pair as shown in FIGS. 2 and 3.

Turning then to FIGS. 2 and 3, one part of a tool pair is shown (FIG. 2), wherein a triple gang subelement die is shown located in a first cavity and a quad gang subelement die is shown located in a second cavity. Each subelement die is separately operable, and through selective movement of a sheet exposed to the tool pair and selective operation of one or both dies, the sections shown in FIG. 1 can be created.

What is claimed:

1. A method for making an embossed article where the article comprises a first composite design element having a plurality of spaced apart design subelements, the method comprising:

mounting a first embossing tool to an embossing press wherein the first embossing tool includes first and second male dies, each die comprising embossing means for creating at least one design subelement, and a space there between;

mounting a second embossing tool to the embossing press in registered opposition to the first embossing tool wherein the second embossing tool includes first and second female dies complementary in number, type and position to the respective first and second male dies, and a space there between;

positioning a first deformable sheet material between the first and second embossing tools, and operating the tools with sufficient force to cause deformation of the first sheet material;

modifying the inter-die spacing between the first and second dies in the first and second embossing tools, and positioning one of a) the first deformable sheet material or b) a second deformable sheet material between the modified first or second embossing tools, and operating the tools with sufficient force to cause deformation of the first or second sheet material.

2. The method of claim 1 wherein the first male die corresponds to a single design subelement.

3. The method of claim 1 wherein the first male die corresponds to a plurality of design subelements.

4. The method of claim 3 wherein the space between the first male die and the second male die is substantially equivalent to the space between the design subelement embossing means in the first male die.

5. The method of claim 1 wherein the first male die corresponds to a plurality of design subelements and the second male die corresponds to a plurality of design subelements.

6. The method of claim 5 wherein the space between the first male die and the second male die is substantially equivalent to the space between any design subelement embossing means in the first or the second male dies.

7. The method of claim 1 wherein each die includes a lateral spacing shoulder that is approximately 50% of the spacing between design subelement embossing means such that when two dies are placed adjacent to one another in a tool they will have generally the same inter-subelement embossing means spacing as a single die having an equivalent number of design subelements embossing means.

8. A method for making an embossed article where the article comprises a first composite design element having a plurality of spaced apart design subelements, the method comprising:

mounting a first embossing tool to an embossing press wherein the first embossing tool includes independently operable first and second dies, each die comprising embossing means for creating at least one design subelement, and a space between said first and second dies;

mounting a second embossing tool to the embossing press in registered opposition to the first embossing tool wherein the second embossing tool includes first and second dies complementary in number, type and position to the respective first and second dies of the first embossing tool, and a space between said first and second dies;

positioning a first deformable sheet material between the first and second embossing tools, and operating the first embossing tool first die with sufficient force to cause deformation of the sheet material, and repositioning the first deformable sheet material between the first and second embossing tools, and operating the first embossing tool second die with sufficient force to cause deformation of the first deformable sheet material.

9. The method of claim 8 wherein the first embossing tool first die corresponds to a single design subelement.

10. The method of claim 8 wherein the first embossing tool first die corresponds to a plurality of design subelements.

11. The method of claim 10 wherein the space between the first embossing tool first die and the second die is substantially equivalent to the space between the design sub-element embossing means in the first male die.

12. The method of claim 8 wherein the first embossing tool first die corresponds to a plurality of design subelements and the first embossing tool second die corresponds to a plurality of design subelements.

13. The method of claim 12 wherein the space between the first embossing tool first die and the first embossing tool second die is substantially equivalent to the space between any design subelement embossing means in the first embossing tool first or the second dies.

14. The method of claim 8 wherein the first male die corresponds to three design subelements and the second male die corresponds to four design subelements.

* * * * *